United States Patent [19]

Levasseur

[11] Patent Number: 4,991,739

[45] Date of Patent: Feb. 12, 1991

[54] VENDING MACHINE

[75] Inventor: Joseph L. Levasseur, Chesterfield, Mo.

[73] Assignee: Coin Acceptors, Inc., St. Louis, Mo.

[21] Appl. No.: 230,983

[22] Filed: Aug. 10, 1988

[51] Int. Cl.[5] ..... G07F 11/10; G07F 11/24

[52] U.S. Cl. ..... 221/14; 221/129; 221/266

[58] Field of Search ..... 221/6, 14, 18, 19, 114, 221/115, 67, 126, 127, 129, 266, 295

[56] References Cited

U.S. PATENT DOCUMENTS

| | | | |
|---|---|---|---|
| 2,735,580 | 2/1956 | Galin et al. | 221/127 |
| 3,055,544 | 9/1962 | Krakauer et al. | 221/14 |
| 3,057,513 | 10/1962 | Turman | 221/114 |
| 3,104,779 | 9/1963 | Denzer | 221/200 |
| 3,110,417 | 11/1963 | Wingate et al. | 221/111 |
| 3,467,275 | 9/1969 | Vaughan | 221/197 |
| 3,904,076 | 9/1975 | Payne | 221/67 |

*Primary Examiner*—F. J. Bartuska

*Attorney, Agent, or Firm*—Cohn, Powell & Hind

[57] ABSTRACT

This vending machine includes a housing frame (12) subdivided into vertical columns (1–8) adapted to receive cylindrical articles (C). Elongate, rotatable support members (60) are provided below each column for supporting the column of articles, which tend to rotate under the weight of the articles. A ratchet wheel (70) and pawl member (80) assembly provided at one end of each support member provides a release mechanism controlling rotation of the support member incident to dispensing an article. The release mechanism associated with a selected column is actuated by an indexing member (94) carried by an endless loop (100) driven by an electric motor (M). The indexing member is positioned adjacent one of the pawl members to dispense an article by moving an associated pawl member into and out of engagement with the ratchet wheel in response to customer selection. A depletion detection device (500) is provided, which includes a sensing member 502 adapted to move in response to the article depletion and connected to the pawl member by a trigger (504) operatively connected to a depletion indicator.

28 Claims, 9 Drawing Sheets

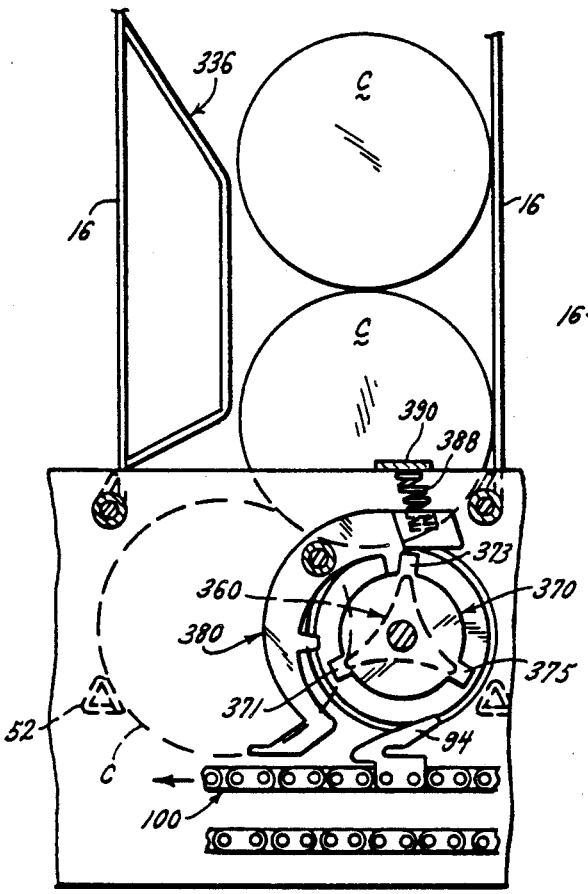
FIG. 11.
FIG. 17.
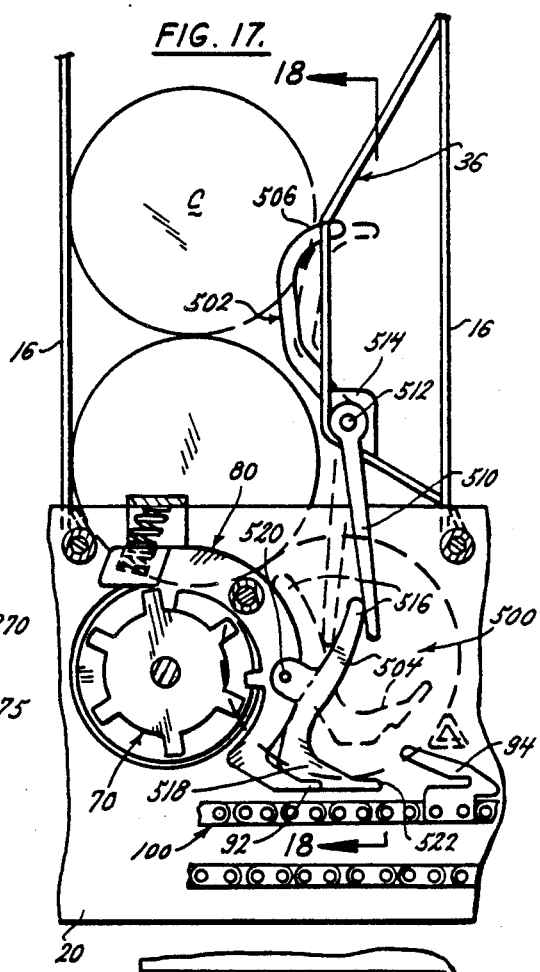
FIG. 18.
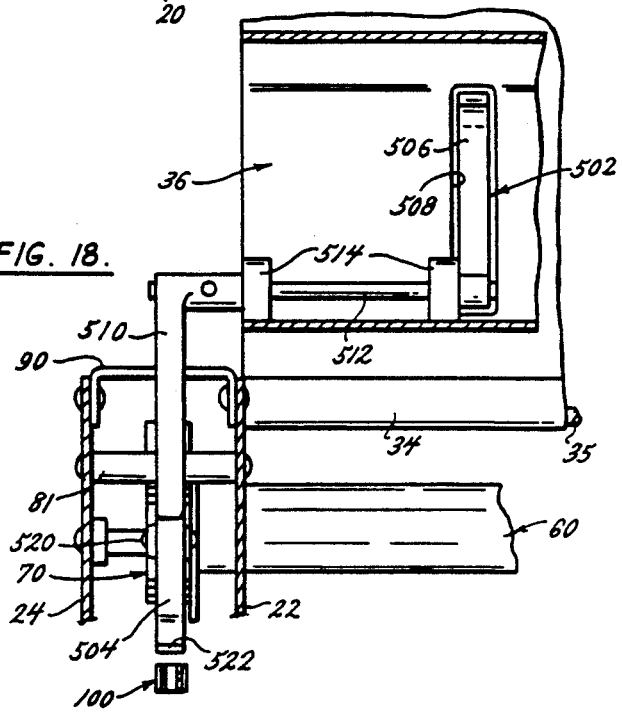

FIG. 3.
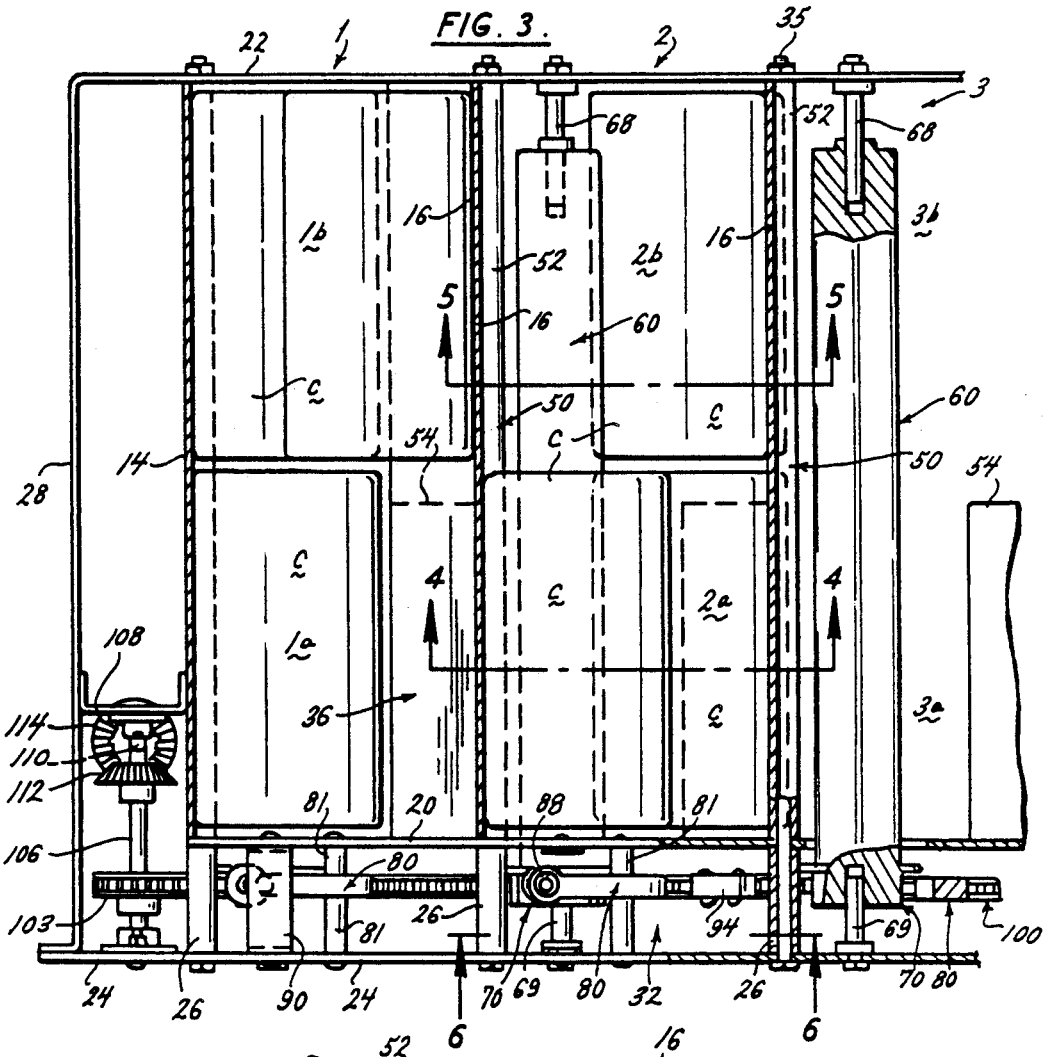
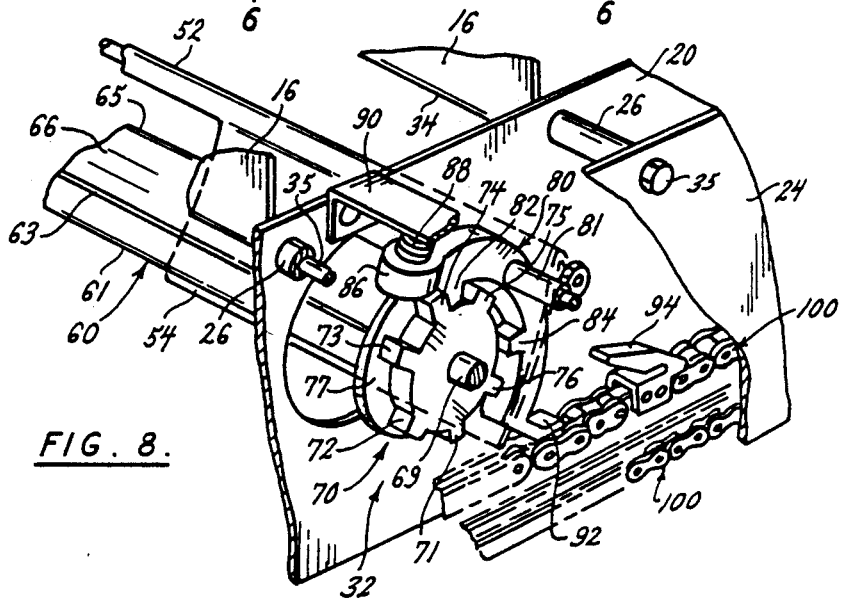
FIG. 8.

FIG. 13.
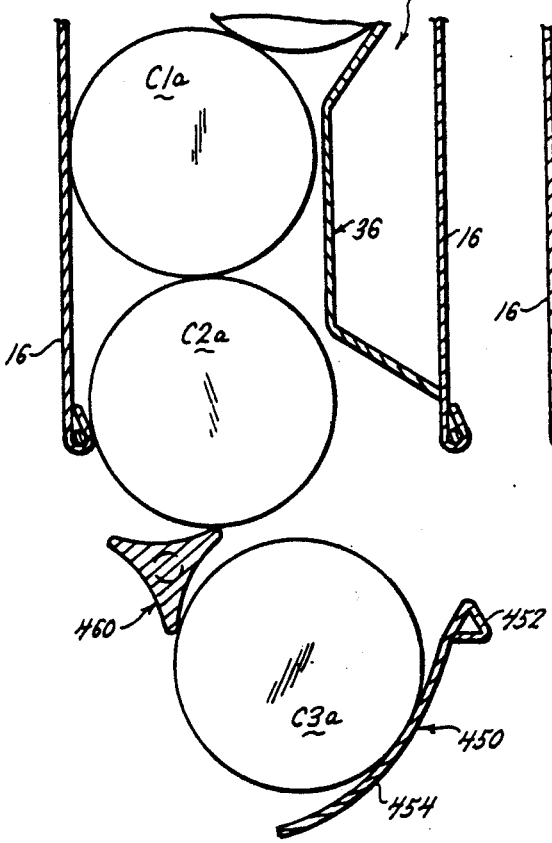
FIG. 14.
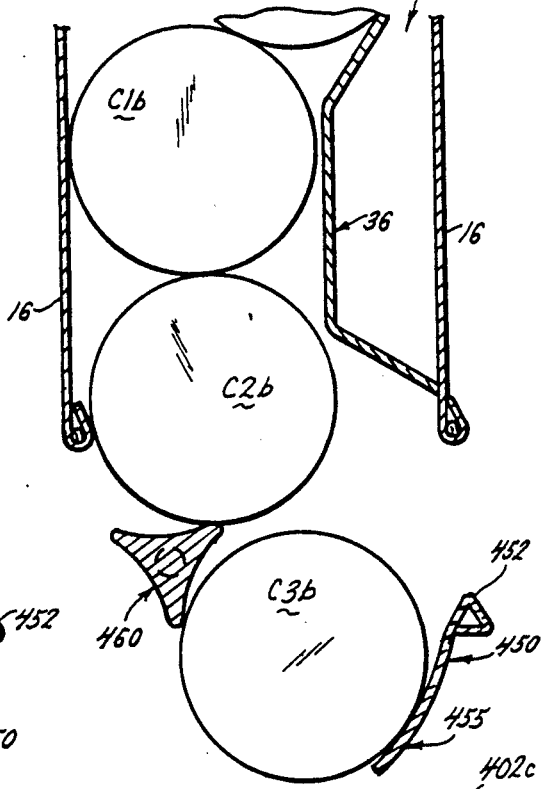
FIG. 16.
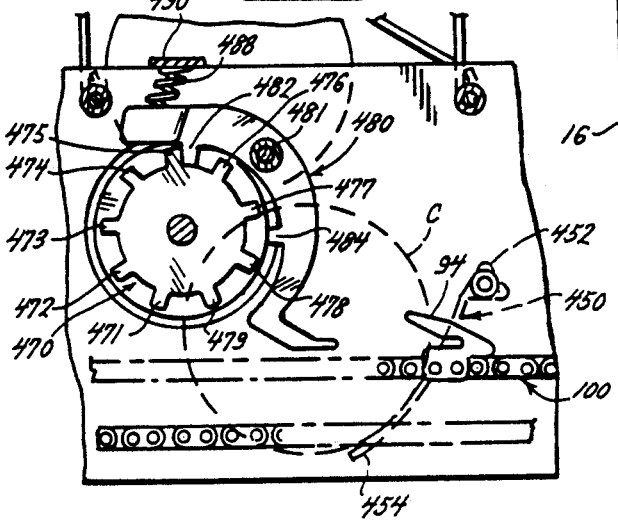
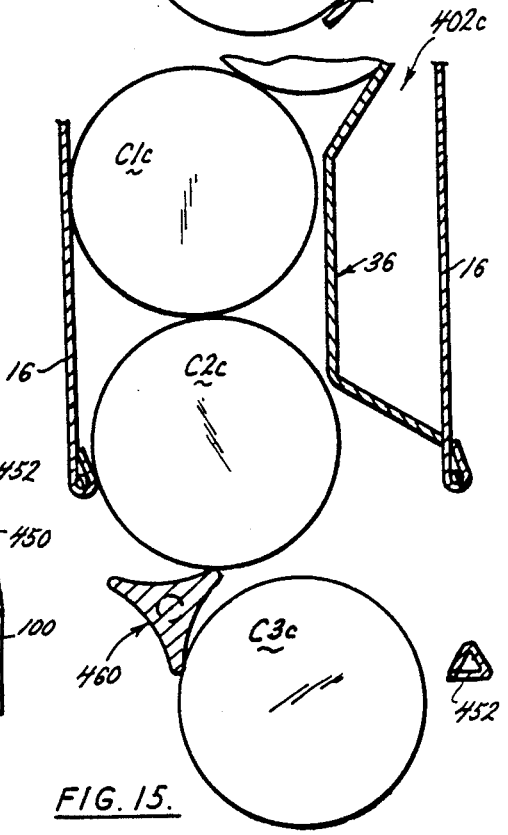
FIG. 15.

FIG. 21.
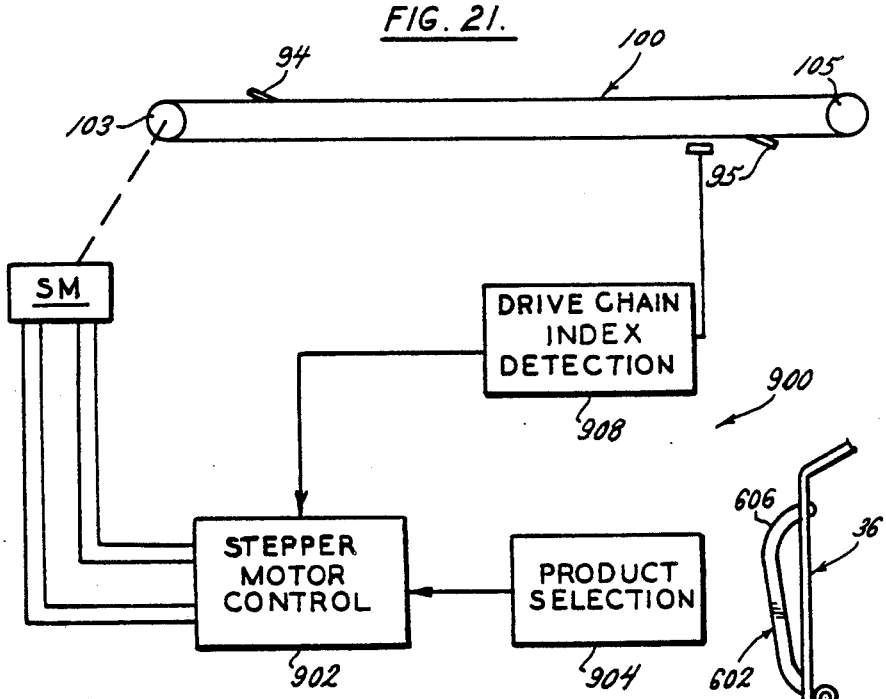
FIG. 19.
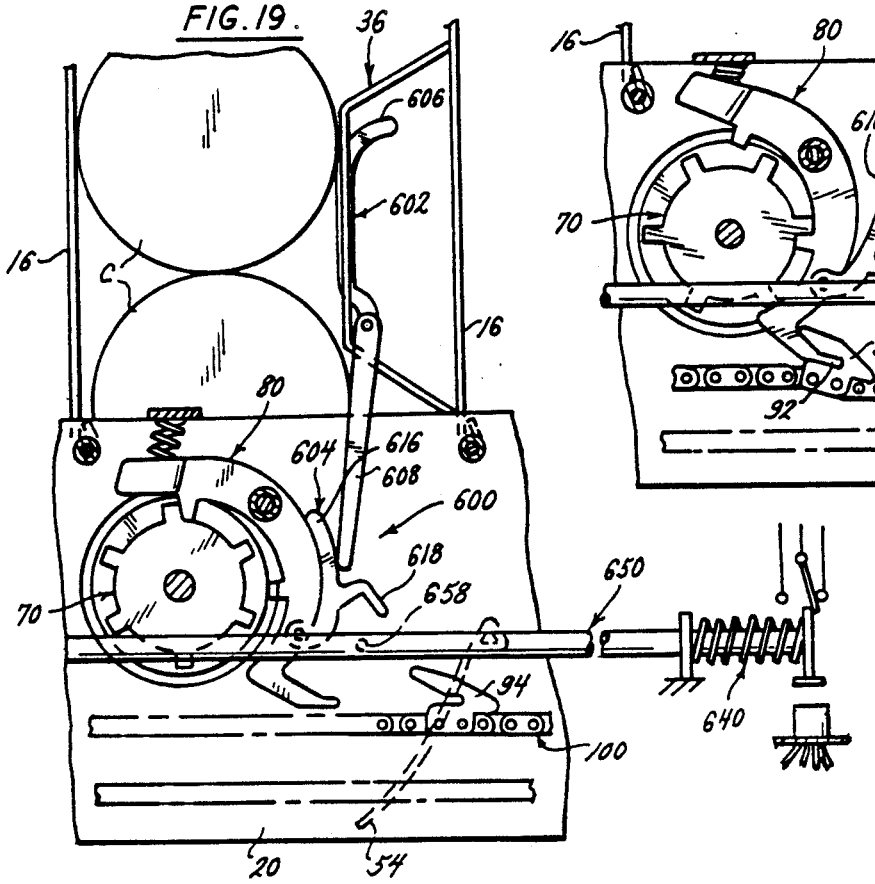
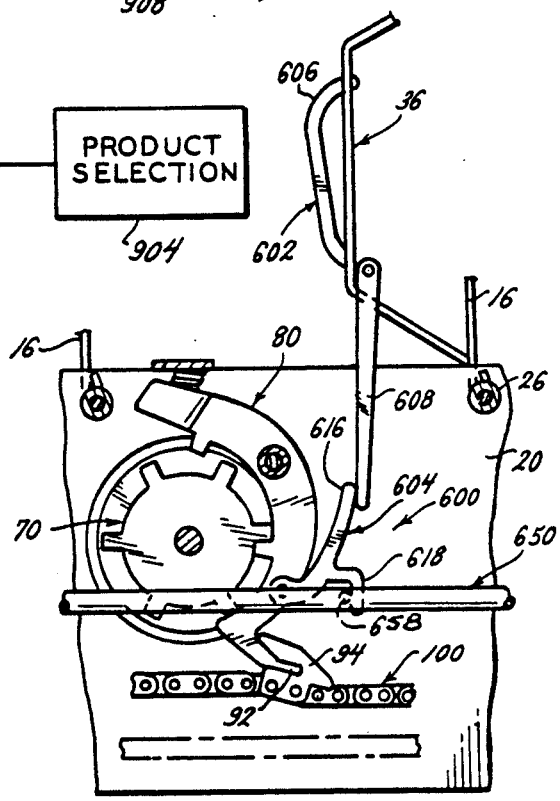
FIG. 20.

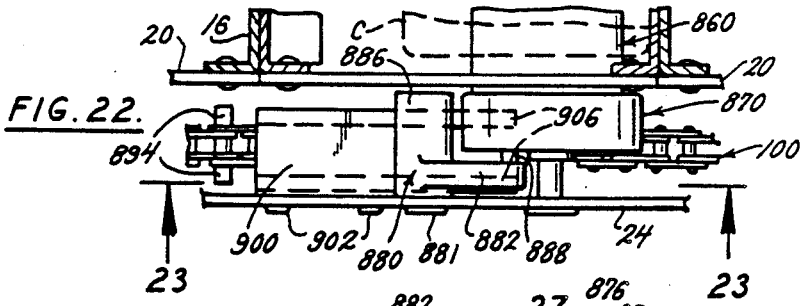
FIG. 22.
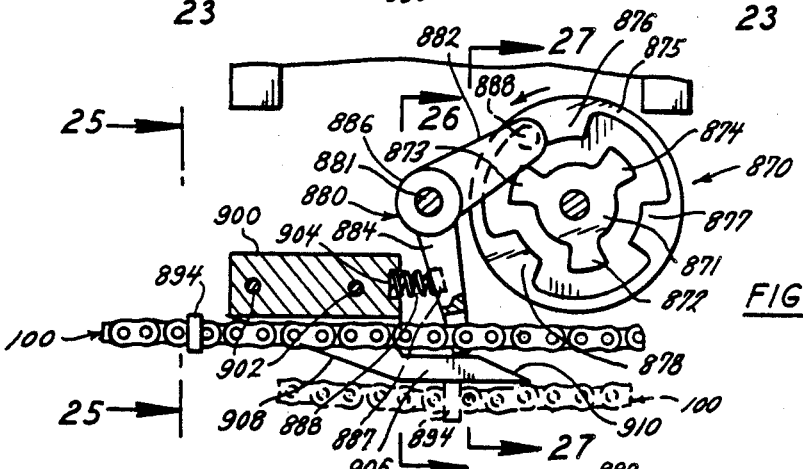
FIG. 23.
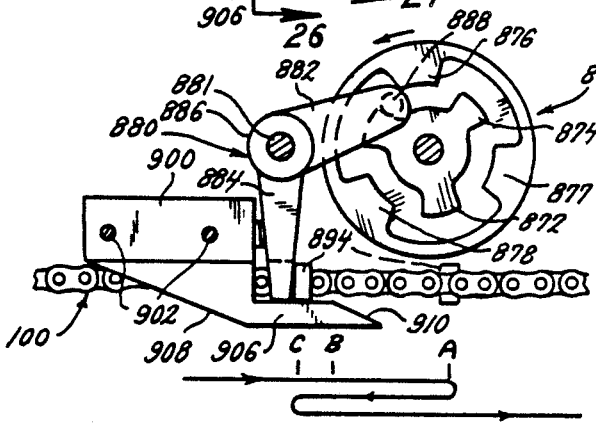
FIG. 24.
FIG. 28.
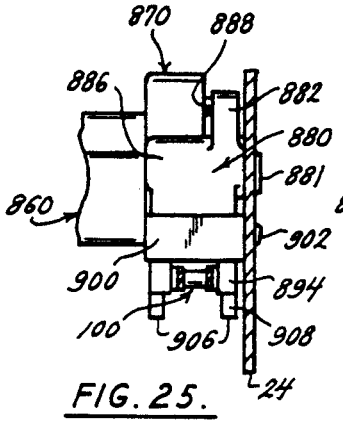
FIG. 25.
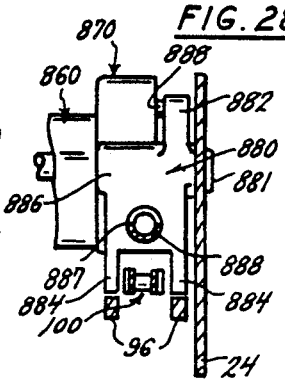
FIG. 26.
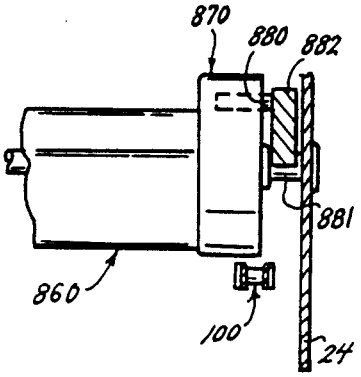
FIG. 27.

VENDING MACHINE

BACKGROUND OF THE INVENTION

This invention relates generally to vending machines and particularly to an improved vending machine for dispensing cylindrical product containers such as bottles or cans in response to customer selections.

It is important in vending machines of the type under consideration to maximize storage capability and minimize the complexity of the delivery mechanism. The aim is that the product should occupy as much of the available interior space as possible thereby reducing overall size requirements.

A problem with many conventional machines is that they utilize a considerable number of switches and associated wiring as well as complicated delivery mechanisms. For example, multiple selection machines frequently rely on multiple motor or solenoid operated delivery mechanisms. Not only do such switches and mechanisms consume valuable space but they render the machine susceptible to high maintenance costs.

Also important, with respect to efficient space utilization is the organization of the storage space. The simplest and most efficient storage lies in the use of vertical column loading but this often presents a problem because of the weight of the product. Accordingly, some machines utilize slant shelf arrangements or serpentine arrangements which reduces the gravity effect often at the expense of simplicity or storage space.

Conventional vending machines suffer from a lack of versatility in successfully allocating storage spaces for the anticipated product consumption for each selection. In some vending machines the problem is solved by simply providing additional columns to anticipated prime selections. Recent innovations have resulted in the use of diverting techniques which can result in some product being maintained in the machine for unreasonable lengths of time as well as increasing costs and decreasing reliability. While the application of anticipated use prediction techniques is desirable, the development of dispensing systems capable of utilizing these techniques has not been available.

The present vending machine solves these and other problems not disclosed in the known prior art.

SUMMARY OF THE INVENTION

This vending machine is provided with a dispensing mechanism which is ideally suited to utilize sophisticated anticipated use predicting techniques which reduce restocking and maintain product freshness and helps to prevent depletion of popular selections.

This vending machine provides a particularly efficient product storage capability by reducing the space requirements for switching and delivery mechanisms. In this machine switching is virtually eliminated and the delivery mechanism is simplified by reducing the requirement for multiple electromagnet devices such as motors and solenoids to a minimum by utilizing common drive mechanisms.

The product storage capability is additionally enhanced by independent front and rear storage of the vertical columns.

An effective electro-mechanical depletion device is provided which is independent of an initial product count.

It is an aspect of this invention to provide a vending machine which includes an article storage means having a plurality of substantially vertical columns disposed in side-by-side relation, each column being adapted to receive a plurality of vertically adjacent generally cylindrical articles; an elongate, rotatable support means disposed below each column and having a plurality of support elements, each support means having opposed ends and operatively supporting an article in a first position and tending to rotate to a second position under the weight of the article; release means, longitudinally spaced from the support elements, connected to each support means and selectively controlling rotation of the support means between the first and second position incident to releasing an article; actuating means reciprocatively engageable with a selected release means to release said release means and permit rotation of the associated support means, and control means for the actuating means.

It is another aspect of this invention to provide that each release means includes a ratchet means fixedly attached to one end of an associated support means and rotatable with said support means, and pawl means pivotally mounted adjacent said ratchet means and movable into and out of engagement with said ratchet means to permit rotation of said support means.

Still another aspect of this invention is to provide that each ratchet means is integrally formed with its associated support means.

Another aspect of this invention is to provide that each support means has a three-pointed star configuration.

Yet another aspect of this invention is to provide that the axis of rotation of each support means is disposed within the associated substantially vertical column.

It is one aspect of this invention to provide that each release means includes a first engagement means, and to provide that the actuating means includes an endless element having a second engagement means, means moving said endless element in one direction of travel and providing a temporary reversal of the direction of travel of said second engagement means, and means precluding operative engagement of said second engagement means with said first engagement means in one direction of travel but permitting operative engagement of said first engagement means by said second engagement means in said temporary reversal of said direction of travel.

It is another aspect of this invention to provide that the actuating means includes a reversible electric motor or a stepper motor driving said endless element.

Still another aspect of this invention is to provide that each support means is formed from a bar having a substantially uniform cross section with a three-pointed star configuration and to provide that the ratchet means is a ratchet wheel integrally formed with said bar and having a plurality of ratchet teeth at equally spaced intervals, and to provide that the pawl means is an escapement member having spaced lug members sequentially engageable with said teeth.

Another aspect of this invention is to provide that each column includes a lower end and a member disposed at said lower end to narrow the exit and direct said articles onto said associated support means.

Yet another aspect of this invention is to provide deflecting means precluding operative engagement of said indexing member with said pawl means in one direction of travel but permitting operative engagement of said pawl means in said temporary reversal of said direction of travel so that said indexing member moves said pawl means into and out of engagement with said ratchet means, and It is one aspect of this invention to provide that each vertical column includes a first portion and a second portion, each column portion being adapted to receive a plurality of vertically adjacent, generally cylindrical articles, each rotatable support means supports articles in said first and second column portions and each of said first column portions includes an escrow member disposed below said support means and providing a hold position for delivering said articles in said first column portion sequentially with said articles in said second column portion, and to provide that each ratchet means includes six teeth.

It is one aspect of this invention to provide that each vertical column includes a first, a second and a third column portion, each column portion being adapted to receive a plurality of vertically adjacent, generally cylindrical articles, each rotatable support means supports articles in said first, second and third portions, and each of said first column portions included a first escrow member disposed below said support means and a second escrow member disposed below said support means and shorter than said first escrow member, said first and second escrow means providing hold positions for delivering said articles in said first and second column portions sequentially with each other and with said articles in said third column portions and to provide that each ratchet means includes nine teeth.

It is another aspect of the invention to provide that each vertical column includes a third portion adapted to receive a plurality of vertically adjacent generally cylindrical articles, each rotatable support means includes a coaxial independent support portion supporting articles in said third column portions, each of said independent support portions includes an associated release means including ratchet means fixedly attached to one end of each of said independent support portions, and an independent actuating means is provided for said independent support portion and to provide that each ratchet means attached to said support means in said first and second column portions includes six teeth and each ratchet means attached to said support portion in said third column portion includes three teeth.

Still another aspect of this invention is to provide that the deflecting means precluding operative engagement between said indexing means and said pawl means includes ramp means on one of said means engageable by the other of said means to flex said endless drive element.

Another aspect of this invention is to provide that the deflecting means permitting operative engagement between said indexing means and said pawl means includes tongue means on one of said means and jaw means on the other of said means adapted to receive said tongue means.

Yet another aspect of this invention is to provide that the deflecting means precluding operative engagement between said indexing means and said pawl means includes a fixed vamp means disposed adjacent said endless element and engageable by said indexing means to flex said endless element.

It is an aspect of this invention to provide a ratchet wheel having an inner portion having a plurality of outwardly extending inner teeth and an outer portion having a plurality of inwardly extending outer teeth disposed in alternating relation with said inner teeth to define a cam path, and to provide that the pawl means includes a biased bell crank member having a cam follower engageable with said inner and outer teeth within said cam path.

It is an aspect of this invention to provide a depletion detector including a first member pivotally attached to the article storage means adjacent each column of articles at an elevation to engage an article and substantially maintain a first position when at least one article is at that elevation, and to pivot substantially away from said one position when all articles are below that elevation, and to provide indicator means responsive to said pivotal movement.

It is another aspect of this invention to provide a depletion detector including a second member pivotally attached to said pawl means and movable with said pawl means and including a first portion and a second portion, said first portion being engaged by the second portion of said first member and pivotally movable by said second portion of said first member when said first member pivots to said second position, and indicator means responsive to said movement of said second portion of said second member resulting from movement of said first member together with movement of said pawl means resulting from engagement by said indexing means.

It is one aspect of this invention to provide that the indexing means is engageable with said second portion of said second member to provide said indicator means.

It is another aspect of this invention to provide that indicator means includes a rod having a plurality of spaced pins selectively engageable by said second portion of said second member and movable with said second member.

It is an aspect of this invention to provide a vending machine which includes an article storage means including a plurality of storage compartments disposed in side-by-side relation, each compartment being adapted to receive a plurality of adjacent articles; a support means disposed at the end of each compartment and operatively supporting an article in a first position and tending to move to a second position under the weight of the article; release means controlling movement of the support means between the first and second position incident to releasing an article; actuating means for the release means including an endless drive element having an engagement means, means moving said endless element in one direction of travel and providing a temporary reversal of the direction of travel of said engagement means, and means precluding operative engagement of said second engagement means with said release means in one direction of travel but permitting operative engagement of said release means by said engagement means in said temporary reversal of said direction of travel, and control means for said actuating means.

BRIEF DESCRIPTION OF THE DRAWINGS

FIG. 3 is a plan view taken on line 3—3 of FIG. 1;

FIG. 8 is a perspective view of the release mechanism;

FIG. 11 is a rear end view taken on line 11—11 of FIG. 11 showing a third column portion delivery mechanism in a holding position;

FIG. 13 is a cross sectional view taken on line 13—13 of FIG. 12 showing the delivery operation in a first column portion;

FIG. 14 is a cross sectional view taken on line 14—14 of FIG. 12 showing the delivery operation in a second column portion;

FIG. 15 is a cross sectional view taken on line 15—15 of FIG. 12 showing the delivery operation in a third column portion;

FIG. 16 is a front end view taken on line 16—16 of FIG. 12 showing the release mechanism in a holding position;

FIG. 17 is a similar view to FIG. 6 showing a depletion detection mechanism;

FIG. 18 is a cross sectional view taken on line 18—18 of FIG. 17;

FIG. 19 is a similar view to FIG. 17 showing a modified depletion detection mechanism in an inoperative condition;

FIG. 20 is a similar view to FIG. 19 showing the modified depletion mechanism in an operative condition; operation;

FIG. 21 is a block diagram showing a modified sequence of operation;

FIG. 22 is a fragmentary plan view of another modified vending machine;

FIG. 23 is a front end view taken on line 23—23 of FIG. 22 showing the delivery mechanism in a holding position;

FIG. 24 is a similar view to FIG. 23 showing the delivery mechanism in a release position;

FIG. 25 is a cross sectional view taken on line 25—25 of FIG. 23;

FIG. 26 is a cross sectional view taken on line 26—26 of FIG. 23;

FIG. 27 is a cross sectional view taken on line 27—27 of FIG. 23, and

FIG. 28 is a diagrammatic view showing the travel of the actuating mechanism.

DESCRIPTION OF THE PREFERRED EMBODIMENT

Figure 1:
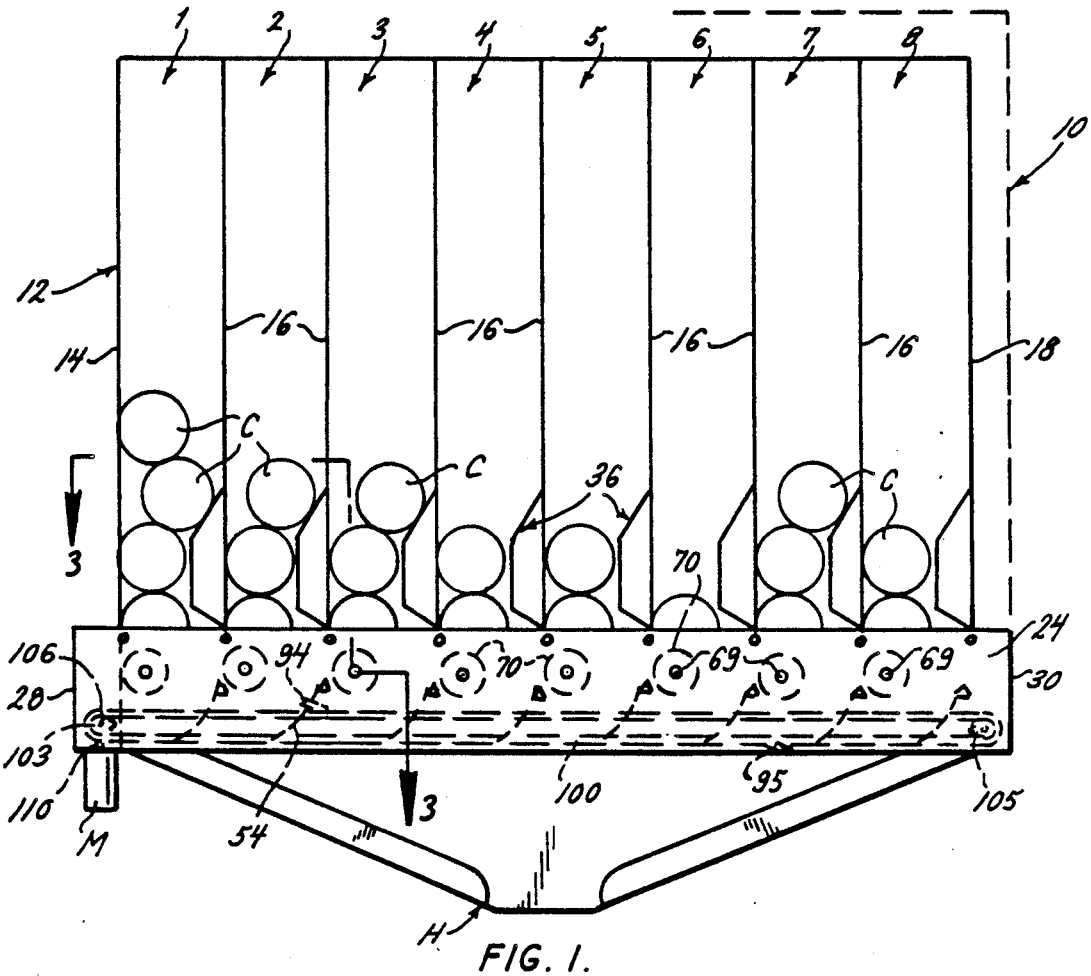
FIG. 1 is a schematic front view of the vending machine.

Referring now by reference numerals to the drawings and first to FIGS. 1 and 3 it will be understood that the vending machine 10 includes a frame 12 divided, in the embodiment shown, into eight storage compartments 1–8 by end walls 14 and 18 and intermediate partition walls 16. In the embodiments shown the compartments are substantially vertical. As shown in FIG. 3, the columns 1–8 are of sufficient depth to provide forward portions 1*a*, 2*a*, 3*a*, etc. and rearward portions 1*b*, 2*b*, 3*b*, etc. so that each column can accommodate two cylindrical articles or containers C such as cans or bottles, end to end. Each of the columns 1–8 is of sufficient width to accommodate staggered vertical rows of said containers C. The frame 12 also includes front and rear plates 20 and 22, connecting the partition walls 16; a front guard plate 24 spaced from said front plate 20, as by spacers 26, and side plates 28 and 30 which interconnect the rear plate 22 and the front guard plate 4. Plates 20 and 24 cooperate to provide a housing for the container release mechanism which is generally indicated by numeral 32 and will be described later. The frame 12 includes a hopper portion H which routes containers C dispensed by the release mechanism to the consumer.

Figure 4:
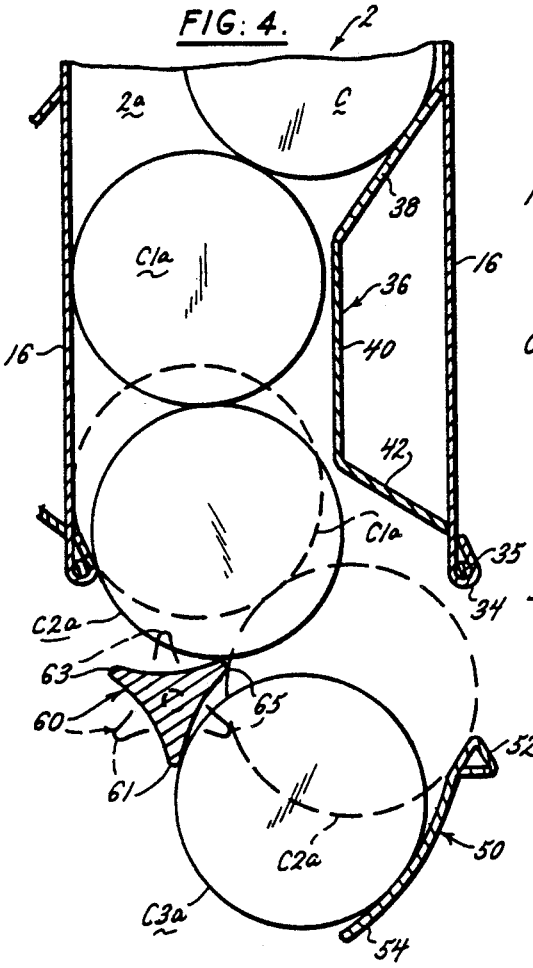
FIG. 4 is a cross sectional view taken on line 4—4 of FIG. 3 showing the delivery operation in a first column portion.
Figure 5:
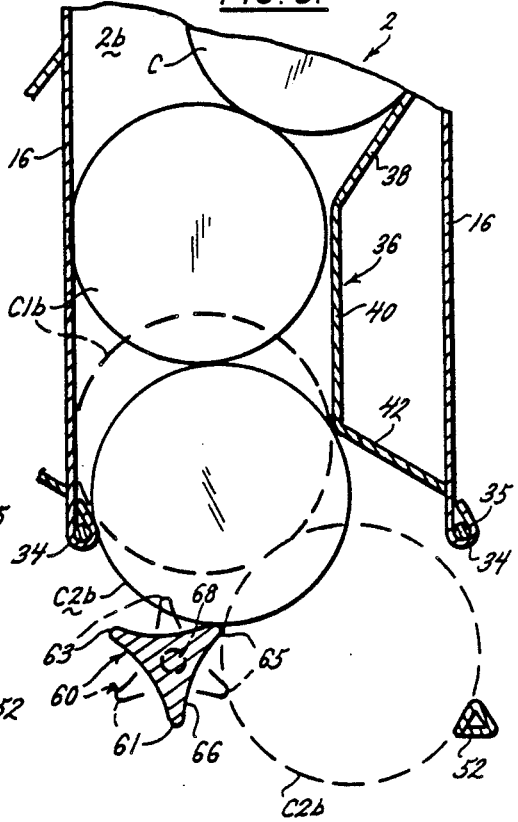
FIG. 5 is a cross sectional view taken on line 5—5 of FIG. 3 showing the delivery operation in a second column portions.

Referring now to FIGS. 4 and 5 it will be understood that partition plates 16 defining columns 1–8 are rolled at their lower end to provide a transverse bead 34 receiving elongate bolts 35, and that above the column exit defined by said beads, each of said plates 16 includes a transverse member 36, attached as by welding. The transverse members 36 effectively narrow the column and define the exit path of the containers C therein, said members 36 including an upper ramp portion 38, a vertical portion 40 and a lower inclined portion 42. Below the transverse member 36 is a retainer plate 50 which includes an upper portion 52, extending between and connected to front and rear plates 20 and 22 and, in the front portion of the column only, a curved escrow portion 54.

The containers are passed through the column exit by means of a three-point turnstile member 60 disposed below each column, which is axially supported in rotatable relation between the rear plate 22 and the guard plate 24 and cooperates with the retainer 50 to provide a turnstile system. In the embodiment shown the turnstile member 60, which is generally star-shaped in configuration, includes three points 61, 63 and 65 separated by concave surfaces 66 compatibly configurated to support a container C. The turnstile members 60 are mounted between the rear and guard plates 22 and 24 by stub shafts 68 and 69, respectively, in freely rotatable relation. The turnstile members provide support means for the containers and the axis of rotation of said members is disposed within the column and offset from the weight center of the supported container. The result of this is that the turnstile members tend to rotate under the weight of the containers.

In the turnstile and retainer assembly shown in FIGS. 3–5, the three-point turnstile 60 extends through columns the front and rear columns, e.g. column portions 2*a* and 2*b* and each turnstile supports two containers C. the upper portion 52 of the retainer 50 also extends through the front and rear columns but the lower, escrow portion extends only through the front column portion 2*a*. Corresponding containers C1*a* and C1*b*, C2*a* and C2*b* in the front and rear column portions are axially aligned. The containers C1*a* and C1*b*, C2*a* and C2*b* and C3*a* are shown in full line representation in a first position, and in phantom outline representation in a second position. One hundred and twenty degrees (120°) of movement of the turnstile member 60 are required to release a container C.

In FIGS. 4 and 5 the turnstile projection 65 holds containers C2*a* and C2*b* in the front and rear portions of column 2 in the position shown in full line representation. In FIG. 4 the turnstile projection 61 cooperates with the escrow portion 54 to hold container C3*a* in the position shown in full line representation.

When the turnstile member 60 is allowed to rotate sixty degrees (60°) to the position shown in phantom outline container C3*a* is delivered and containers C2*a* and C2*b* both move to the position shown in phantom outline in which they are supported by turnstile projection 65 and retainer member 52. When the turnstile member 60 is allowed to rotate a further sixty degrees (60°) container C2*a* will move into the position formerly occupied by container C3*a* and be held by the turnstile member 60 and cooperating escrow portion 54 in the front column portion. Container C2*b* however will be delivered since no escrow portion is provided in the rear column portion. Thus containers C are delivered alternately from each column portion for each sixty degrees (60°) of rotation of the turnstile member 60 but one hundred and twenty degrees (120°) of movement are necessary to deliver a container from the same column.

Figure 6:
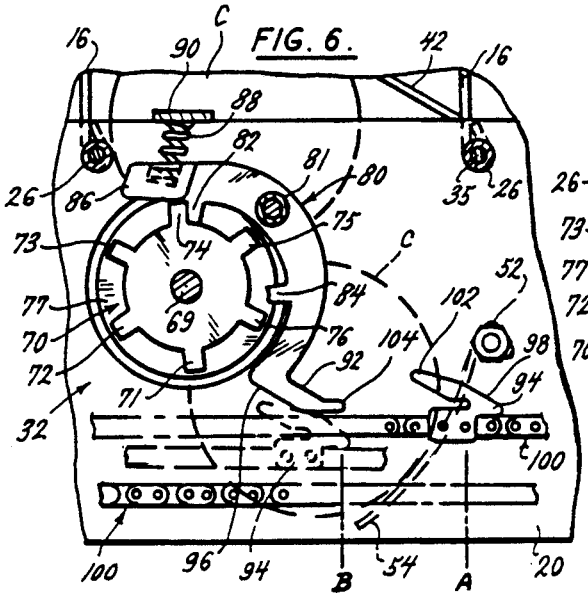
FIG. 6 is a front end view taken on line 6—6 of FIG. 3 showing the release mechanism in a holding position.
Figure 7:
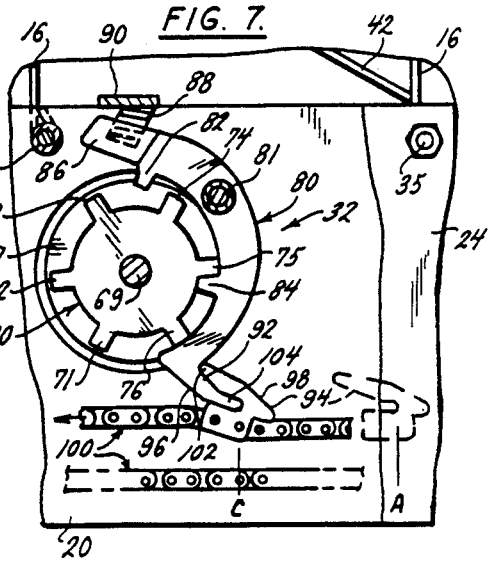
FIG. 7 is a similar view to FIG. 6 showing the release mechanism in a release position.

The release mechanism which controls the rotation of the turnstile member 60 from a first position, in which they are supported by the turnstile member, to a second position incident to being dispensed will now be described with particular reference to FIGS. 6–8.

As shown in FIG. 8 each turnstile member 60 extends through the front plate 20 and is provided at its front end with a coaxially integrally mounted and integrally formed ratchet wheel 70 which rotates with the turnstile member 60. The ratchet wheel 70 includes a plurality of radially extending teeth 71–76, six (6) in number in the embodiment shown, and a circular back plate 77. An escapement member or pawl 80 is pivotally mounted adjacent the ratchet wheel 70 by a pivot shaft 81 extending between the front wall 20 and the guard wall 24. The escapement member 80 is generally arcuate and includes lugs 82 and 84 which are engageable respectively with the ratchet wheel teeth 74 and 76 in the position shown. At its upper end, the escapement member 80 includes a socket 86 providing a seat for the lower end of a spring 88 and said spring is engageable at its upper end with an abutment member 90 with the result that the lug 82 is biased into engagement with the uppermost tooth 74.

At its lower end the escapement member 80 includes an outstanding member 92, constituting a first engagement means, which is engageable by a reciprocable indexing finger 94, constituting a second engagement means. In effect, the turnstile members and the release mechanism cooperate to block delivery of the containers from the columns.

Figure 9:
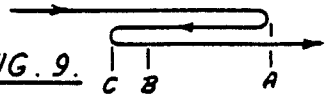
FIG. 9 is a diagrammatic view showing the travel of the release actuating mechanism.

In the embodiment shown, the indexing finger 94 is fixedly mounted, as by rivets, to a chain 100. The reverse ramp configuration of the underside 96 of the member 92 constitutes a detecting means and cooperates with the upperside 98 of the member 94 in view of the flexibility of the chain 100 to permit the finger 94 to pass under the escapement member 80 when the chain 100 moves in a clockwise direction of travel to point A (FIGS. 6 and 7), but provides that the projecting member will engage and pivot the escapement member when the chain moves in a reverse, counterclockwise direction of travel from point A through point B to point C (FIG. 9). More particularly, it will be understood that the jaw-like configuration of the finger opening 102 provides an underside ramp surface receiving the tongue-like configuration of the projecting member tip 104 such that counterclockwise movement of the finger 94 beyond point B pivots the escapement lug 82 out of engagement with the ratchet tooth 74 so that the turnstile member 60 rotates under the weight of a container until the second tooth engages the second lug 84 as shown in FIG. 6. Further clockwise movement of the finger 94 from C towards B results in reverse pivoting of the escapement member under the biasing action of the spring 88 so that the lug 82 engages the next tooth and resulting in a total movement of the ratchet wheel 72 of sixty degrees (60°).

In the embodiment shown a total movement of one hundred twenty degrees (120°) is necessary to release a container C so that the front and rear containers in a column are released consecutively as the turnstile 60 and ratchet wheel 70 are rotated at sixty degree (60°) intervals.

Figure 2:
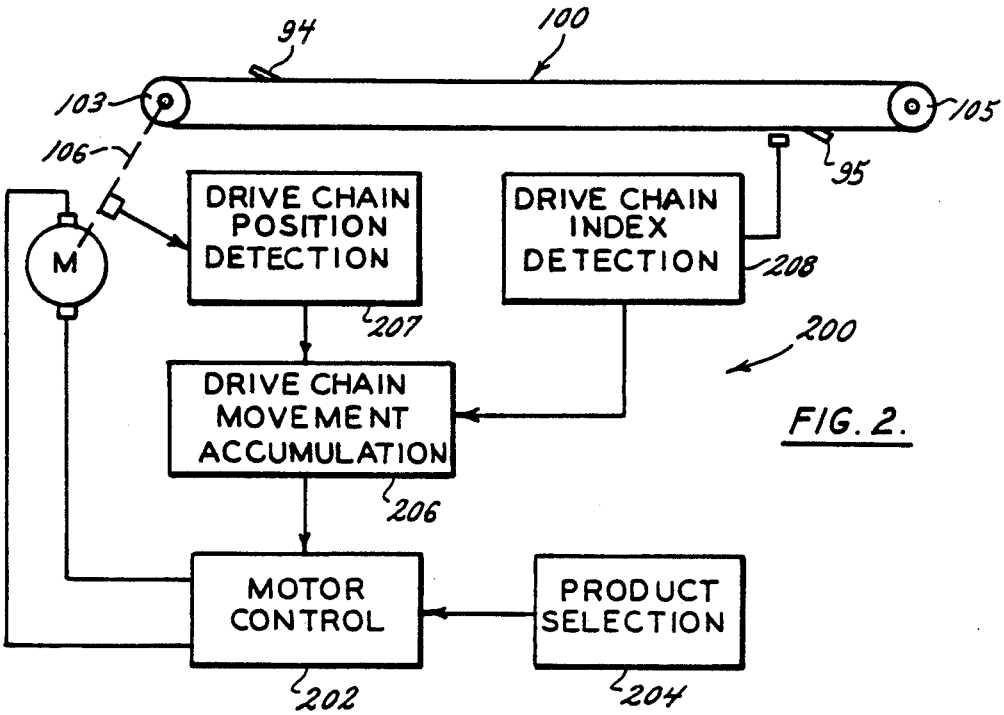
FIG. 2 is a block diagram showing the sequence of operations.

In the preferred embodiment shown in FIG. 2, chain 100 has two (2) indexing fingers 94 and 95 mounted thereon at diametrically opposite points which provides that one index finger is always available on the upper flight. The chain is disposed about a drive sprocket 103 and an idler sprocket 105 and is driven by a reversible motor M. As shown in FIG. 3 the drive sprocket 103 is fixedly mounted to a drive shaft 106 rotatably mounted between the guard plate 24 and a bracket 108, said shaft being driven from the motor M by means of miter gears 112 and 114 carried by the motor shaft 110 and the drive shaft 106 respectively.

The motor M is controlled by a control system 200 which is shown in the schematic diagram of FIG. 2. Essentially, the drive chain 100 is moved clockwise in order to position one of the two fingers for example finger 94, adjacent the escapement member 80 (FIG. 6) of a selected column 1–8 by a Motor Control 202 following an initiation of the Product Selection 204 by a customer. The Product Selection can be coin or credit controlled or, alternatively, can be adapted to be in a free operating mode. Data in the Drive Chain Movement Accumulator 206 provides information to the Motor Control 202 as to the position of the index finger 94. This information together with the output from the Product Selection 204 is compared by said Motor Control 202 to properly advance the index finger 94 to the correct position through the medium of motor M, motor shaft 106, sprocket 103 and chain 100. When this position is reached the Motor Control 202 causes the index finger 94 to reciprocate and activate the selected release mechanism pawl 80.

More specifically, the Drive Chain Movement Accumulator 206 stores a numerical value representation the location of the index fingers 94 and 95 at all times. Movement of the chain 100 is monitored by sensing the rotation of the sprocket drive shaft 106 as by a shaft encoder which provides output pulses in accordance with its rotation and is one method of providing the Drive Chain Position Detection 207. Other methods include, for example, a sprocket tooth sensor using a Hall Effect device or optical coupler; or using an optical detector circuit to detect the movement of the chain links. The starting point for accumulating chain movement is provided by a Drive Chain Index Detector 208 which observes the index fingers 94 and 95 with a Hall Effect device to provide a reset pulse output to the Drive Chain Movement Accumulator 206 whenever an index finger is at a start point.

In the preferred embodiment the electronic control system utilizes a microprocessor but can also be implemented using logic gate circuitry.

Figure 10:
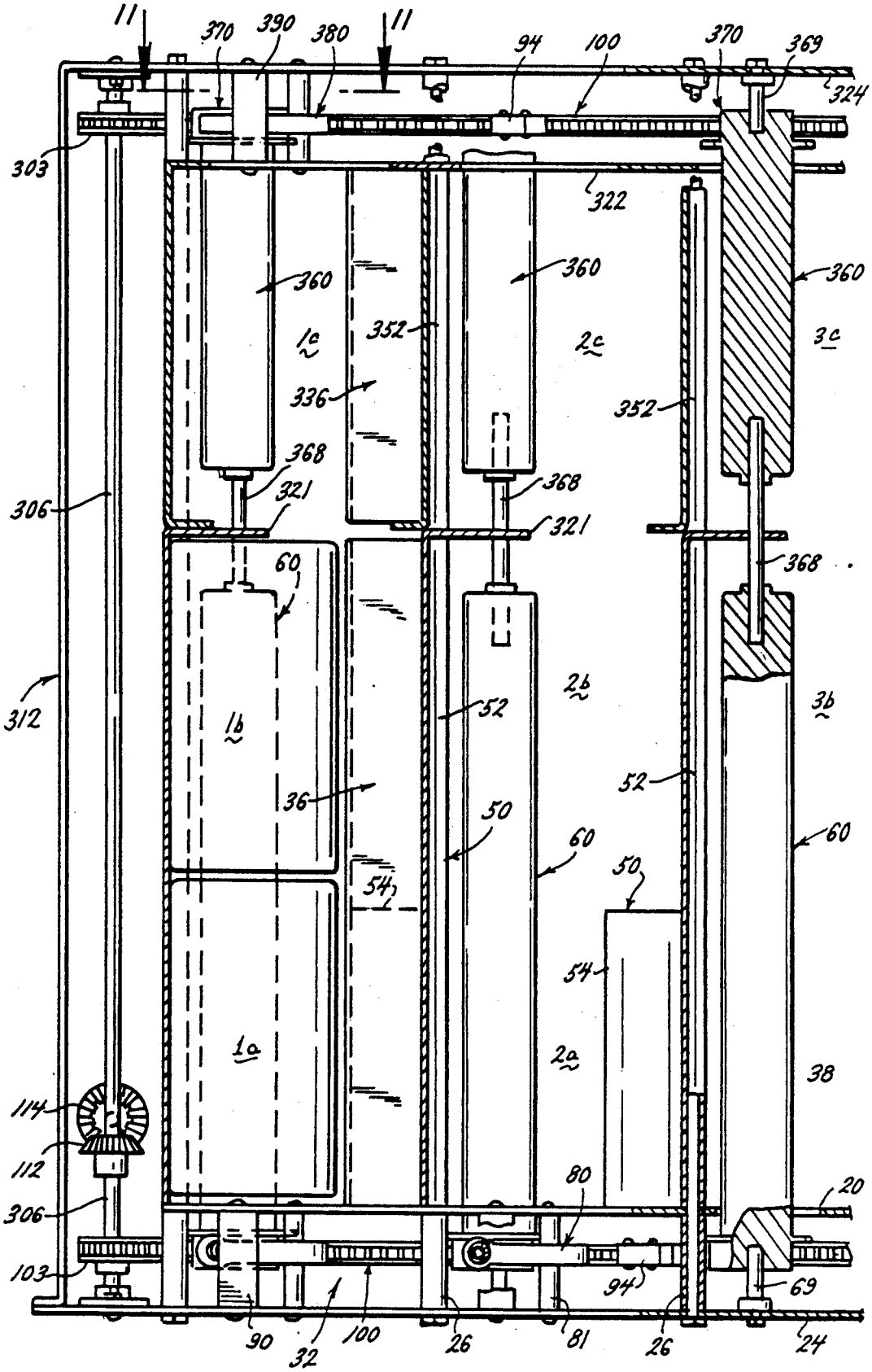
FIG. 10 is a plan view of a modified vending machine.
Figure 12:
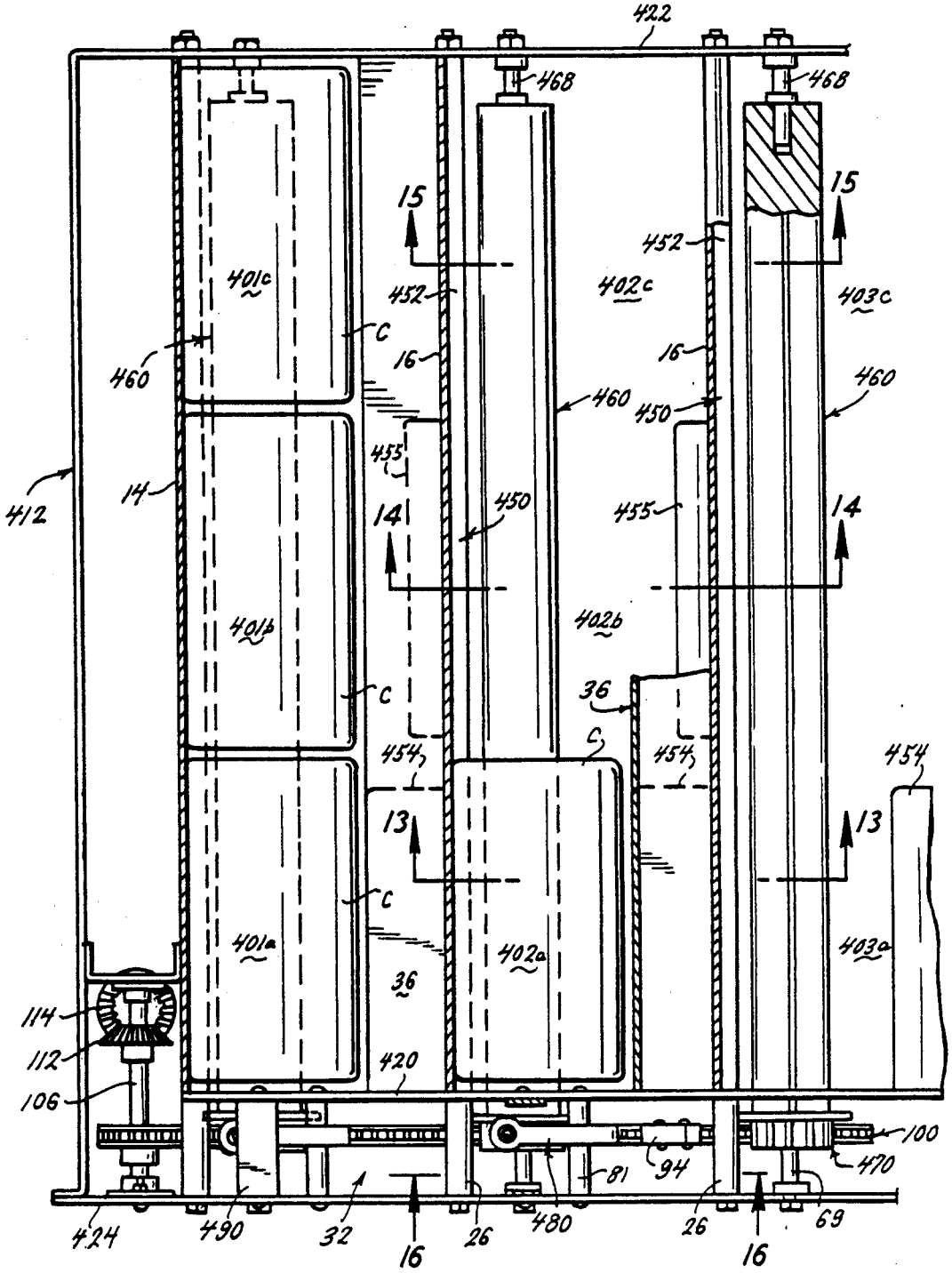
FIG. 12 is a plan view of another modified vending machine.

Another preferred embodiment is shown in FIGS. 10 and 11. In this embodiment a deeper frame 312 is used providing an additional third set of column portions 1*c*, 2*c*, 3*c*, etc. The forward two column portions 1*a*, 2*a*, 3*a*, etc. and 1*b*, 2*b*, 3*b*, etc. are substantially as described above with respect to FIGS. 3–7. However, in this modified structure additional single turnstile members 360 are provided each of which is independently rotatable relative to turnstiles 60. As shown each turnstile member 360 is mounted to rear guard plate 324 by stub shaft 369 and a common shaft 368 is used to mount turnstile members 60 and 360 to intermediate wall 321. A second chain 100 is provided which is driven by a second sprocket 103 fixedly mounted to the rear end of an extended drive shaft 306. As shown in FIG. 11, the turnstile member 360 is substantially identical in cross section to turnstile member 60. The escapement member 380 is also substantially identical except that it is mounted in mirror-image. The ratchet wheel 370 and escrow plate arrangement are however different. The ratchet wheel 370 includes only three (3) teeth since only one column portion is serviced by the index finger. In addition, there is no comparable escrow plate portion and each engagement of the index finger 94 with the pawl 80 results in rotation of the ratchet wheel 370 and the turnstile member 360 of one hundred and twenty degrees (120°). In other respects the delivery operation is substantially similar to that already described with respect to the rear column portion 2*b* shown in FIGS. 3–5.

Another preferred embodiment is shown in FIGS. 12–16. This embodiment also employs a deeper frame 412 to provide a third set of column portions 401*c*, 402*c*, 403*c*, etc. The two forward column portions 401*a*, 402*a*, 403*a*, etc. and 401*b*, 402*b*, 403*b*, etc. are substantially as described above with respect to FIGS. 3–7. However, the turnstile member 460 is lengthened to extend into the third column portion and is mounted to rear wall 422 by stub shaft 468. As shown in FIG. 13 the turnstile member 460 is substantially identical in cross section to turnstile member 60. The escapement member 480 is also substantially identical to escapement member 80. The ratchet wheel 470 and the retainer member are, however, different. The ratchet wheel 470 includes nine (9) teeth 471–479 since all three column portions e.g. 402*a*, 402*b* and 402*c* are serviced by the same index finger. The retainer escrow plate 454 in the front column is substantially similar to that in the front column portion of the embodiment shown in FIGS. 3–7 and there is likewise no escrow plate in the rear column portion. However, a shortened escrow plate 455 is provided in the second or intermediate column portion.

As has already been discussed with respect to the embodiment disclosed in FIGS. 3–7, one hundred and twenty degrees (120°) rotation of a turnstile member 460 is necessary to release a container C. Accordingly, each reciprocation of the finger moves the turnstile through forty degrees (40°) with the result that containers C are released consecutively in the first, second and third column portions e.g. 402*a*, 402*b* and 402*c* respectively.

With turnstile 460 having just rotated to the position shown in FIGS. 13–15, containers C1*a*, C1*b* and C1*c* are axially aligned. Likewise, containers C2*a*, C2*b* and C2*c* are axially aligned. Also, containers C3*a*, C3*b* and C3*c* are axially aligned, C3*c* being aligned only momentarily since it is on the point of leaving the position shown in FIG. 15, to be dispensed because the third column portion 402*c* has no escrow plate. With the next forty degree (40°) rotation of turnstile member 460, container C3*b* is dispensed because it will no longer be retained by the shortened escrow plate 455. At the same time container C3*b* is dispensed, container C3*a* moves from the position shown in FIG. 13 to be retained by the lowest portion of escrow plate 454, and will be dispensed with the next forty degree (40°) rotation.

FIGS. 17 and 18 illustrate a modified release mechanism which incorporates a depletion detection mechanism 500. This mechanism consists essentially of two cooperating elements, namely, a container sensing arm 502 and a pivotal trigger 504. The container sensing arm includes an upper portion 506 disposed within a slot 508 provided in the transverse member 36 and a lower portion 510, which is engageable with the trigger 504. The upper and lower portions 508 and 510 are connected by a shaft 512, which is mounted to a pair of brackets 514 for pivotal movement of the sensing arm 502. The trigger 504 also includes an upper portion 516 and a lower portion 518 and is pivotally mounted to the escapement member by a pivot shaft 520. The lower portion 518 is arcuate to provide a tongue 522. When the column of containers C is at a higher elevation than the sensing arm upper portion 506, said upper portion is urged by the containers into the position shown in phantom outline in FIG. 18 and the lower portion urges the trigger tongue 522 clear of the index finger 94. When the column of containers C is depleted to a sufficiently low elevation, the sensing arm is moved counterclockwise automatically, under gravity, which permits the trigger 504 to pivot clockwise into the position shown in full lines. In this position the tongue 522 acts as an extension of the escapement tongue 92 and is engaged by the index finger 94 ahead of its normal engagement with said escapement tongue 522. This engagement is detected and recorded by the control system to limit, or prevent, additional vending.

A modified depletion detection mechanism 600 is shown in FIGS. 19 and 20. This mechanism is similar to that described above in that it includes container sensing arm 602 and a trigger 604 which is pivotally mounted to the escapement member 80. However, the trigger 604 is selectively engageable with an independent spring-loaded rod 650, which is provided with a spring-loaded switching means 640 and a plurality of pins 651–658.

The container sensing arm 602 is pivotally mounted to member 36 and includes an upper portion 606 engageable with the containers C and a lower portion 608 which is engageable with the trigger 604. The trigger 604 also includes an upper portion 616 and a lower portion 618 and is pivotally mounted to the escapement member 80. The trigger lower portion 618 is arcuate in configuration to provide a hook. When the column of containers C is higher than the sensing arm 602 the upper portion 602 is urged by the containers C into the position shown in FIG. 19 and the lower portion 608 urges the trigger hook 618 clear of the rod pin 602. When the column of containers C is sufficiently depleted the sensing arm 602 is moved counterclockwise automatically, under gravity, which permits the trigger 604 to pivot clockwise into the position shown in FIG. 20, in which the hook 618 engages and actuates the rod 650 and the switch 640 as the rod 650 moves with counterclockwise movement of the escapement member 80 under engagement by the indexing finger 94. This engagement is detected and recorded by the control system to limit or prevent additional vending of the release mechanism.

Another modified construction of the release mechanism is shown in FIGS. 22–27. This construction employs a substantially identical turnstile member 860 but in combination with an integrally formed compound ratchet wheel 870 and a pawl 880. The compound ratchet wheel 870 includes an inner portion 871 having three (3) outwardly projecting teeth 872, 873 and 874 and an outer portion 875 having three (3) inwardly projecting teeth 876, 877 and 878 disposed circumferentially intermediate teeth 872, 873 and 874. The inner and outer portions 871 and 875, respectively, cooperate to define a grooved, cam-like, path. The pawl 880 is pivotedly mounted between front plate 20 and the guard plate 24 by pivot 881 and has a bell crank configuration including a first arm 882 and a second arm 884 extending from a common hub 886. The first arm 882 is laterally offset from the second arm 884, as shown in FIG. 25, and includes a right-angularly projecting cam-follower 888 at its remote end which is engageable with the teeth of the inner and outer portions of the ratchet wheel 870. The second arm 884 is bifurcated at its lower end to straddle the chain 100 which is provided with a pair of transverse lugs 894, constituting any indexing member which is fixedly attached to and provides lateral projections on each side of said chain. The second arm 884 includes a socket 887, which receives a spring 888 extending between said second arm and an abutment member 900 attached to the guard plate 24 as by fasteners 902 and having a spring-receiving socket 904.

The abutment 900 also includes bifurcated legs 906 which provide a first ramp face 908 and a second ramp face 910. The indexing element 894 is wider than the opening defined by the bifurcated legs 906 and, as shown in FIG. 23 in phantom outline, engages the first ramp face 908 and is cammed downwardly by virtue of the flexibility of the chain 100 to pass under the abutment forwardly projecting portion 912 below the pawl 880. When clear of the abutment 900 the chain reverts to its original travel position as shown in FIG. 24. It will be understood that reverse movement of the chain from A-B causes the indexing element to engage the pawl 880 second arm 884, assisted by the second ramp face 910, which rotates said pawl to position C and rotates its cam-follower 888 in a clockwise direction and out of engagement with outer tooth 874. With the removal of the stop provided by the cam follower 888, the ratchet wheel 870 rotates counter-clockwise until it engages inner tooth 874. When the direction of the chain 100 is again reversed, the indexing element 890 moves out of engagement with the pawl second arm 884, which rotates said pawl in a counterclockwise direction so that the cam follower 888 moves out of engagement with inner tooth 874 and, following further rotation of the ratchet wheel 870, moves into engagement with the outer tooth 877. Thus, reciprocal movement of the chain 100 moves the ratchet wheel 870, in two sixty degree (60°) stages, through one hundred and twenty degrees (120°) of angular movement. This modified construction in other respects operates substantially as described for the embodiments already discussed.

FIG. 21 is another block diagram similar to FIG. 2 and shows a modified control system 900, incorporating a stepper motor SM which, when pulsed by a Stepper Motor Control 902, moves the chain 100 a precise, predetermined small amount for each said pulse. Upon initiation of Product Selection 904 by a customer the motor SM is stepped continuously until the chain index finger 94 is detected by the Drive Chain Index Detection 908. Then, depending upon the product selected, the determination of the precise number of pulses required to move the chain is provided to position the chain index finger 94 in the appropriate location adjacent the selected escapement member 80. The Stepper Motor Control 902 is then pulsed to cause the stepper motor SM to induce reciprocating movement into the index finger 94 the correct amount to operate the escapement member 80.

With respect to the loading of the forward and rearward portions of the columns, it will be understood that the forward portions are front loaded and the rearward portions are top loaded.

It will be understood that the term "vending machine" used herein is intended to include both cash and credit merchandising machines.

Several embodiments of the vending machine have been described above in detail and those skilled in the art will appreciate that modifications may be made without departing from the spirit of this invention. Other modifications are possible, for example the compartments could be inclined rather than vertical. Therefore, it is not intended that the scope of the invention be limited to the specific embodiments illustrated and described. Rather, it is intended that the scope of this invention be determined by the appended claims and their equivalents.

I claim as my invention:

1. A vending machine comprising:

(a) article storage means including a plurality of columns disposed in side-by-side relation, each column being adapted to receive a plurality of adjacent generally cylindrical articles, (b) an elongate, rotatable support means disposed below each column and having a plurality of support elements, each support means having opposed ends and operatively supporting an article in a first position and tending to rotate to a second position under the weight of the article, (c) release means, longitudinally spaced from the support elements, connected to each support means and selectively controlling rotation of the support means between the first and second position incident to releasing an article, (d) actuating means reciprocatively engageable with a selected release means to release said release means and permit rotation of the associated support means, (e) control means for the actuating means, and (f) each release means including a first engagement means, and (g) the actuating means including:

1. an endless element having a second engagement means,
2. means moving said endless element in one direction of travel and providing a temporary reversal of the direction of travel of said second engagement means, and
3. means precluding operative engagement of said second engagement means with said first engagement means in one direction of travel but permitting operative engagement of said first engagement means by said second engagement means in said temporary reversal of said direction of travel.

2. A vending machine as defined in claim 1, in which:

(h) the actuating means includes a reversible electric motor driving said endless element.

3. A vending machine assembly comprising:

(a) article storage means including a plurality of substantially vertical columns disposed in side-by-side relation, each column being adapted to receive a plurality of adjacent generally cylindrical articles, (b) an elongate, rotatable support means disposed below each column and having a plurality of support elements, each support means having opposed ends and operatively supporting an article in a first position and tending to rotate to a second position under the weight of the article, (c) release means including a ratchet means fixedly attached to one end of each support means and rotatable with said support means, and pawl means pivotally mounted adjacent said ratchet means to control rotation of the support means between the first and second position incident to releasing the article, (d) actuating means for the release means including:

1. an endless drive element having an indexing member attached thereto,
2. means moving said endless element in one direction of travel to provide that said indexing member is disposed adjacent a selected pawl means and providing a temporary reversal of the direction of travel of said indexing member, and
3. deflecting means precluding operative engagement of said indexing member with said pawl means in one direction of travel but permitting operative engagement of said pawl means in said temporary reversal of said direction of travel so that said indexing member moves said pawl means into and out of engagement with said ratchet means, and (e) control means for said actuating means.

4. A vending machine as defined in claim 3, in which:

(f) each vertical column includes a first portion and a second portion, each column portion being adapted to receive a plurality of vertically adjacent, generally cylindrical articles, (g) each rotatable support means supports articles in said first and second column portions, and (h) each of said first column portions includes an escrow member disposed below said support means and providing a hold position for delivering said articles in said first column portion sequentially with said articles in said second column portion.

5. A vending machine as defined in claim 4, in which:

(i) each support means has a three-pointed star configuration and each ratchet means includes six teeth.

6. A vending machine as defined in claim 3, in which:

(f) each vertical column includes a first, a second and a third column portion, each column portion being adapted to receive a plurality of vertically adjacent, generally cylindrical articles, (g) each rotatable support means supports articles in said first, second and third portions, and (h) each of said first column portions included a first escrow member disposed below said support means and a second escrow member disposed below said support means and shorter than said first escrow member, said first and second escrow means providing hold positions for delivering said articles in said first and second column portions sequentially with each other and with said articles in said third column portions.

7. A vending machine as defined in claim 6, in which:

(i) each support means has a three-pointed star configuration, and each ratchet means includes nine teeth.

8. A vending machine as defined in claim 4, in which:

(i) each vertical column includes a third portion adapted to receive a plurality of vertically adjacent generally cylindrical articles, (j) each rotatable support means includes a coaxial independent support portion supporting articles in said third column portions, (k) each of said independent support portions includes an associated release means including ratchet means fixedly attached to one end of each of said independent support portions, and (l) an independent actuating means is provided for said independent support portion.

9. A vending machine as defined in claim 8, in which:

(m) each support means including said independent support portion has a three-pointed star configuration, each ratchet means attached to said support means in said first and second column portions includes means attached to said support portion in said third column portion includes three teeth.

10. A vending machine as defined in claim 3, in which:

(f) the deflecting means precluding operative engagement between said indexing means and said pawl means includes ramp means on one of said means engageable by the other of said means to flex said endless drive element.

11. A vending machine as defined in claim 3, in which:

(f) the deflecting means permitting operative engagement between said indexing means and said pawl means includes tongue means on one of said means and jaw means on the other of said means adapted to receive said tongue means.

12. A vending machine as defined in claim 3, in which:

(f) the deflecting means precluding operative engagement between said indexing means and said pawl means includes a fixed ramp means disposed adjacent said endless element and engageable by said indexing means to flex said endless element.

13. A vending machine as defined in claim 3, in which:

(f) the support means is formed from a bar having opposed ends and having a substantially uniform cross section with a three-pointed star configuration, (g) the ratchet means includes a ratchet wheel integrally formed with said bar at one end thereof having a plurality of outwardly extending teeth, and (h) the pawl means includes a biased escapement member sequentially engageable with said teeth.

14. A vending machine as defined in claim 3, in which:

(f) the support means is formed from a bar having opposed ends and having a substantially uniform cross section with a three-pointed star configuration, (g) the ratchet means includes a ratchet wheel integrally formed at one end of said bar having an inner portion having a plurality of outwardly extending inner teeth and an outer portion having a plurality of inwardly extending outer teeth disposed in alternating relation with said inner teeth to define a cam path, and (h) the pawl means includes a biased bell crank member having a cam follower engageable with said inner and outer teeth within said cam path.

15. A vending machine as defined in claim 3, in which:

(f) a depletion detector is provided including:

1. a first member pivotally attached to the article storage means adjacent each column of articles at an elevation to engage an article and substantially maintain a first position when at least one article is at that elevation, and to pivot substantially away from said one position when all articles are below that elevation, and
2. indicator means responsive to said pivotal movement.

16. A vending machine as defined in claim 3, in which:

(f) a depletion detector is provided including:

1. a first member pivotally attached to the article storage means adjacent each column of articles including a first portion and a second portion, said first portion being disposed at an elevation to engage an article and substantially maintain a first position when at least one article is at that elevation and to pivot to a second position when all articles are below that elevation,
2. a second member pivotally attached to said pawl means and movable with said pawl means and including a first portion and a second portion, said first portion being engaged by the second portion of said first member and pivotally movable by said second portion of said first member when said first member pivots to said second position, and
3. indicator means responsive to said movement of said second portion of said second member resulting from movement of said first member together with movement of said pawl means resulting from engagement by said indexing means.

17. A vending machine as defined in claim 16, in which:

(g) said indexing means is engageable with said second portion of said second member to provide said indicator means.

18. A vending machine as defined in claim 16, in which:

(g) said indicator means includes a rod having a plurality of spaced pins selectively engageable by said second portion of said second member and movable with said second member.

19. A vending machine assembly comprising:

(a) article storage means including a plurality of storage compartments disposed in side-by-side relation, each compartment being adapted to receive a plurality of adjacent articles, (b) a support means disposed at the end of each compartment and operatively supporting an article in a first position and tending to move to a second position under the weight of the article, (c) release means controlling movement of the support means between the first and second position incident to releasing an article, (d) actuating means for the release means including:

1. an endless drive element having an engagement means,
2. means moving said endless element in one direction of travel and providing a temporary reversal of the direction of travel of said engagement means, and
3. means precluding operative engagement of said second engagement means with said release means in one direction of travel but permitting operative engagement of said release means by said engagement means in said temporary reversal of said direction of travel, and (e) control means for said actuating means.

20. A vending machine, comprising:

(a) article storage means including a plurality of storage compartments disposed in side-by-side relation, each compartment including generally aligned first and second portions, each portion being adapted to receive a plurality of adjacent articles, (b) an elongate, rotatable support means disposed below each compartment and having a plurality of support elements, each support means having opposed ends and operatively supporting an article in each compartment portion in a first position and tending to rotate to a second position under the weight of the article, (c) a plurality of release means each connected to a support means and selectively controlling rotation of the support means between the first and second position incident to releasing an article each release means including a ratchet wheel having a plurality of teeth and a pawl means, said ratchet teeth being at least twice as many in number as the number of support element on the support means, (d) an escrow means disposed below said support means and the first compartment portion and providing a hold position for delivering said articles in said first compartment portion sequentially with said articles in said second compartment portion, (e) actuating means reciprocatively engageable with a selected pawl means to release said ratchet wheel and permit rotation of the associated support means, and (f) control means for the actuating means.

21. A vending machine as defined in claim 20 in which:

(g) the support means has three support elements and the ratchet wheel has six teeth.

22. A vending machine, comprising:

(a) article storage means including a plurality of substantially vertical columns disposed in side-by-side relation, each column being adapted to receive a plurality of vertically adjacent generally cylindrical articles, (b) an elongate, rotatable support means disposed below each column and having a plurality of support elements, each support means having opposed ends and operatively supporting an article in a first position and tending to rotate to a second position under the weight of the article, (c) release means connected to each support means and selectively controlling rotation of the support means between the first and second position incident to releasing an article, (d) actuating means including an elongate member extending between said release means and having indexing means positionable adjacent a selected release means reciprocatively engageable with said selected release means to release said release means and permit rotation of the associated support means, and (e) control means for the actuating means.

23. A vending machine as defined in claim 22, in which:

(f) the control means includes a position detector means operatively monitoring movement of the elongate members indexing means.

24. A vending machine as defined in claim 23, in which:

(g) the elongate member is a reciprocable endless element.

25. A vending machine, comprising:

(a) article storage means including a plurality of substantially vertical columns disposed in side-by-side relation, each column being adapted to receive a plurality of vertically adjacent generally cylindrical articles, (b) an elongate, rotatable support means disposed below each column and having a plurality of support elements, each support means having opposed ends and operatively supporting an article in a first position and tending to rotate to a second position under the weight of the article, (c) a plurality of release means, longitudinally spaced from the support elements, each connected to a support means and selectively controlling rotation of the support means between the first and second position incident to releasing an article, each release means including rotatable means attached to and rotating with the support means and engagement means including spaced means engageable with said rotating means, one of said spaced means being movable out of engagement with said rotating means and the other of said spaced means being simultaneously movable into incipient engagement with said release means to determine the amount of rotation of said rotatable means, (d) actuating means reciprocatively engageable with a selected release means to release said release means and permit rotation of the associated support means, and (e) control means for the actuating means, (f) each support means having a star configuration substantially smaller than the dispensed article and the axis of rotation of each support means being disposed within the associated substantially vertical column.

26. A vending machine as defined in claim 25, in which:

(g) each column has generally straight sides and includes a lower end and a member disposed at said lower end to narrow the exit and direct said articles onto said associated support means.

27. A vending machine, comprising:

(a) article storage means including a plurality of substantially vertical columns disposed in side-by-side relation, each column being adapted to receive a plurality of vertically adjacent generally cylindrical articles, (b) an elongate, rotatable support means disposed below each column and having a plurality of support elements, each support means having opposed ends and operatively supporting an article in a first position and tending to rotate to a second position under the weight of the article, (c) release means, connected to each support means and selectively controlling rotation of the support means between the first and second position incident to releasing an article, (d) actuating means reciprocatively engageable with a selected release means to release said release means and permit rotation of the associated support means, (e) control means for the actuating means, (f) each release means including a ratchet wheel fixedly attached to one end of an associated support means and rotatable with said support means, and pawl means pivotally mounted adjacent said ratchet means and movable into and out of engagement with said ratchet means to permit rotation of said support means, and (g) the ratchet wheel having a plurality of ratchet teeth at equally spaced intervals, and the pawl means being an escapement member having spaced lug members sequentially engageable with said teeth whereby as one lug means outwardly out of tooth-engagement, the other lug moves inwardly into an incipient tooth-engagement position to provide a stop to accurately determine the amount of rotation of said support means, (h) each support means having a star configuration substantially smaller than the dispenses article and the axis of rotation of each support means being disposed within the associated substantially vertical column.

28. A vending machine as defined in claim 27, in which:

(i) each ratchet wheel is integrally formed with its associated support means.

* * * * *